US008191486B2

(12) United States Patent
Apps et al.

(10) Patent No.: US 8,191,486 B2
(45) Date of Patent: Jun. 5, 2012

(54) NESTABLE PALLET

(75) Inventors: William P. Apps, Alpharetta, GA (US); Gerald R. Koefelda, Rowlett, TX (US); Cynthia R. Aiken, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 13/033,137

(22) Filed: Feb. 23, 2011

(65) Prior Publication Data

US 2011/0139040 A1 Jun. 16, 2011

Related U.S. Application Data

(63) Continuation of application No. 10/340,315, filed on Jan. 9, 2003.

(51) Int. Cl.
*B65D 19/38* (2006.01)

(52) U.S. Cl. ..... 108/57.25; 108/53.3

(58) Field of Classification Search ..... 108/51.11, 108/57.25, 57.26, 57.27, 57.28, 901, 902, 108/53.1, 53.3, 53.5
See application file for complete search history.

(56) References Cited

U.S. PATENT DOCUMENTS

| | | | | |
|---|---|---|---|---|
| 2,916,239 | A * | 12/1959 | Stopps | 108/53.3 |
| 5,791,262 | A * | 8/1998 | Knight et al. | 108/57.25 |
| 5,857,416 | A * | 1/1999 | Donnell et al. | 108/55.3 |
| 5,937,767 | A * | 8/1999 | Togawa et al. | 108/57.26 |
| 6,357,366 | B1 * | 3/2002 | Frankenberg | 108/57.25 |
| 6,718,888 | B2 * | 4/2004 | Muirhead | 108/57.25 |
| 6,874,428 | B2 * | 4/2005 | Apps | 108/57.25 |
| 7,165,499 | B2 * | 1/2007 | Apps et al. | 108/57.25 |
| 7,690,315 | B2 * | 4/2010 | Apps | 108/53.3 |
| 7,726,248 | B2 * | 6/2010 | Shuert | 108/57.25 |
| 7,819,068 | B2 * | 10/2010 | Apps et al. | 108/53.3 |
| 2005/0211139 | A1 * | 9/2005 | Perrotta et al. | 108/57.25 |
| 2010/0043678 | A1 * | 2/2010 | Linares | 108/57.25 |

* cited by examiner

*Primary Examiner* — Jose V Chen
(74) *Attorney, Agent, or Firm* — Carlson, Gaskey & Olds

(57) ABSTRACT

A nestable pallet includes a deck having an upper panel, a lower panel and a plurality of ribs extending perpendicularly from the upper panel to the lower panel. The upper panel further includes a plurality of openings for receiving feet of a similar pallet when nested. The lower panel further includes a plurality of feet extending downward from the deck, each foot having a cavity defined therein lined within one of the plurality of openings in the upper panel. Each cavity is configured to receive a foot from a similar pallet when nested therein.

20 Claims, 13 Drawing Sheets

NESTABLE PALLET

CROSS-REFERENCE TO RELATED APPLICATIONS

This application is a continuation of application Ser. No. 10/340,315, which was filed on Jan. 9, 2003.

BACKGROUND OF THE INVENTION

This invention relates to a nestable pallet for storing or transporting goods.

Pallets are often to used to store and transport goods. The pallets maintain the goods at a distance above the floor such that they can be readily lifted and moved by a fork of a lift truck. Some pallets have stringers or double decks forming openings which receive the forks of the lift truck. Other pallets are nestable within one another to facilitate storage and transport when empty. Generally, nestable pallets typically have openings in their upper surface which receive corresponding shaped feet of a similar nestable pallet. Thus, the nestable pallets are easier to store and transport when empty.

U.S. Pat. No. 6,283,044, assigned to the assignee of the present invention, discloses the use of box beam cross sections to provide a stronger, more durable injection molded pallet. Generally, upper and lower ribbed pallet sections are heat welded together to form the entire pallet. This patent discloses the use of box beam sections only in standard pallets, including rackable and stringer type pallets.

A nestable pallet must provide multiple openings through its deck to receive the feet of a similar pallet. As a result, box beam sections have not been provided in nestable pallets in the prior art. Therefore, prior art nestable pallets have not been able to benefit from the increased strength and durability provided by the box beam section technology.

SUMMARY OF THE INVENTION

The present invention provides the strength of box beam technology in a nestable pallet. Generally, the nestable pallet comprises a deck having an upper panel, a lower panel and a plurality of ribs extending between the panels to form box beam sections. The ribs may comprise upper rib sections extending from the upper panel that are aligned with and secured to lower rib sections extending from the lower panel. The lower panel also includes a plurality of feet each aligned with an opening through the upper panel and each having a cavity defined therein for receiving a foot from a similar pallet when nested.

The nestable pallet of the present invention provides the increased strength and durability of the box beam section in a nestable pallet. Thus, the inventive pallet has increased strength and durability in use and is also convenient to store and transport when empty.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF PREFERRED EMBODIMENTS

Figure 1:
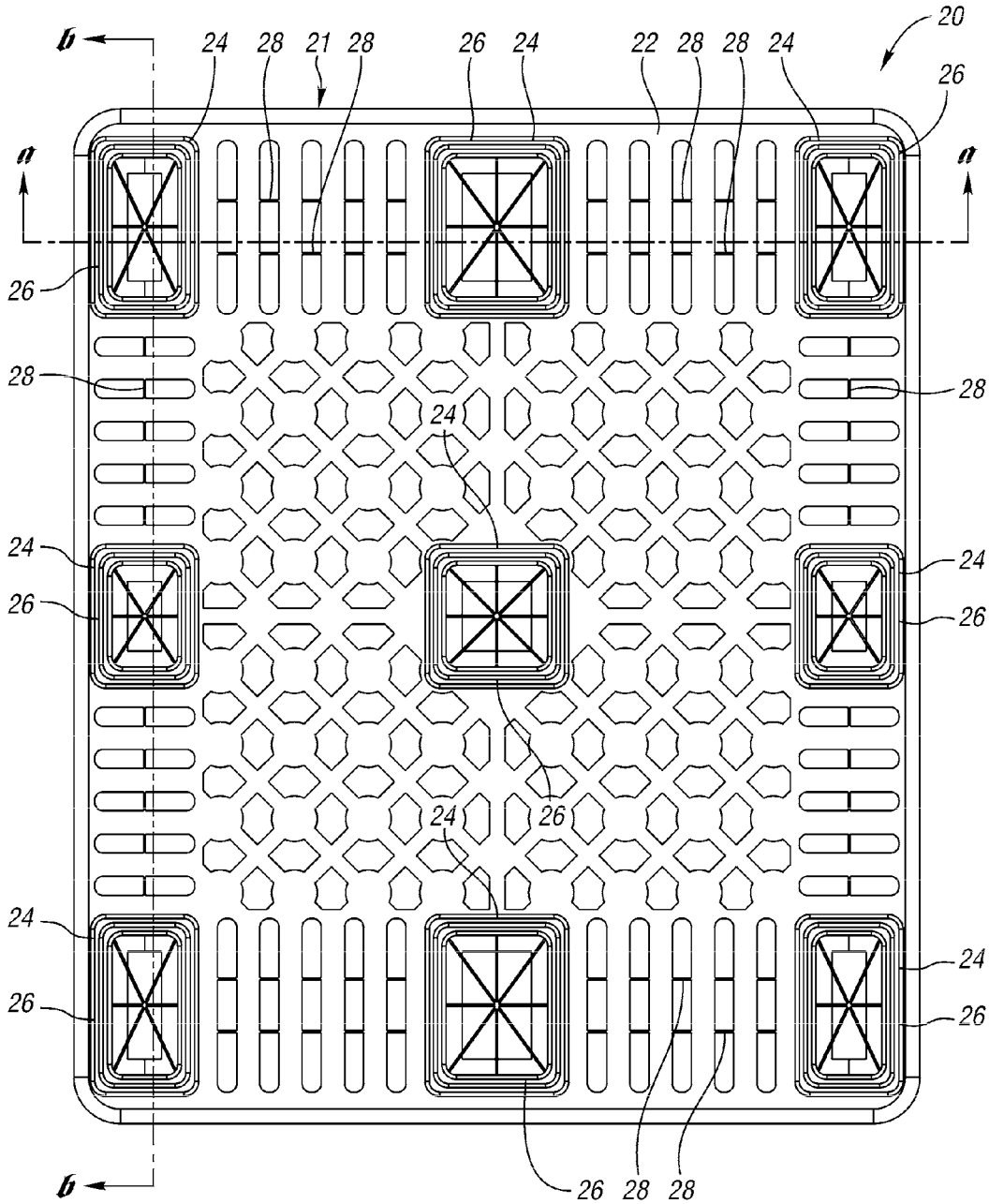
FIG. 1 is a top view of a first embodiment nestable pallet of the present invention.
Figure 2:
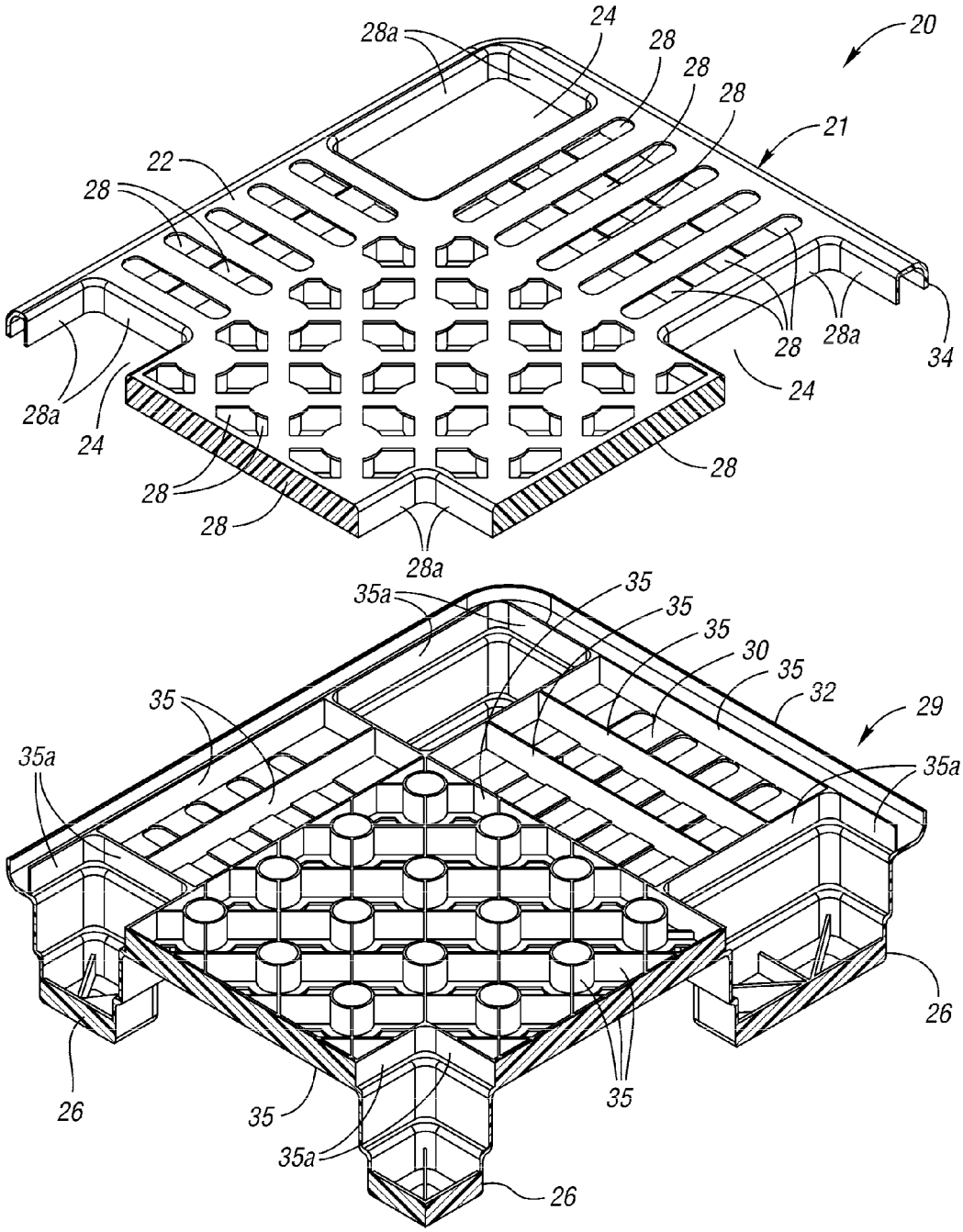
FIG. 2 is an exploded perspective view of a quarter section of the nestable pallet of FIG. 1.

A top view of a nestable pallet 20 according to the present invention is shown in FIG. 1. FIG. 2 is an exploded perspective view of the nestable pallet 20. Referring to FIGS. 1 and 2, the nestable pallet 20 includes an upper deck section 21 comprising an upper panel 22 having a plurality of openings 24 aligned with feet 26 extending downwardly from the pallet 20. The upper panel 22 further includes molded slots and drain holes. A plurality of upper rib sections 28 extend downward from the upper panel 22. At least some of the upper rib sections 28 extend between each adjacent pair of feet 26.

Referring to FIG. 2, the lower deck section 29 includes a lower panel 30 having a lip 32 about the periphery of the nestable pallet for mating with a similar lip 34 of upper panel 22. A plurality of lower rib sections 35 extend upward from the lower panel 30 in general alignment with corresponding upper rib sections 28. Some of the upper and lower rib sections 28*a*, 35*a* are aligned with and disposed on four sides of each of the openings 24 in upper panel 22 to form a portion of each of the feet 26. Each of the upper ribs sections 28 is joined to one of the lower rib sections 35, such as via hot plate welding, or other methods known in the art. The lip 34 in the upper panel 22 may be similarly joined to the lip 32 of the lower panel 30.

Figure 3A:
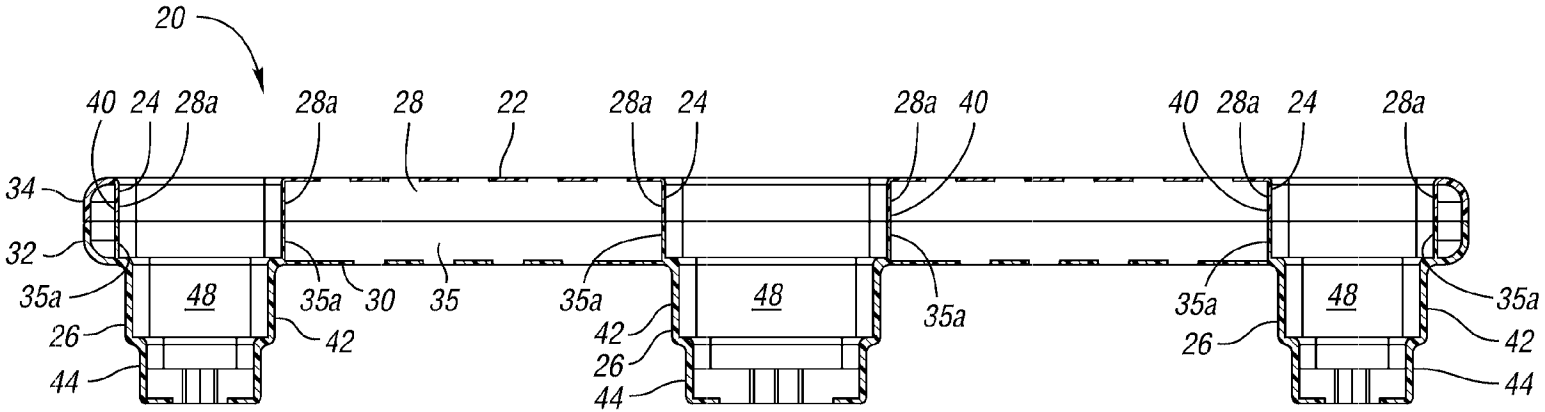
FIG. 3*a* is a sectional view through the nestable pallet of FIG. 1 along line a-a.
Figure 3B:
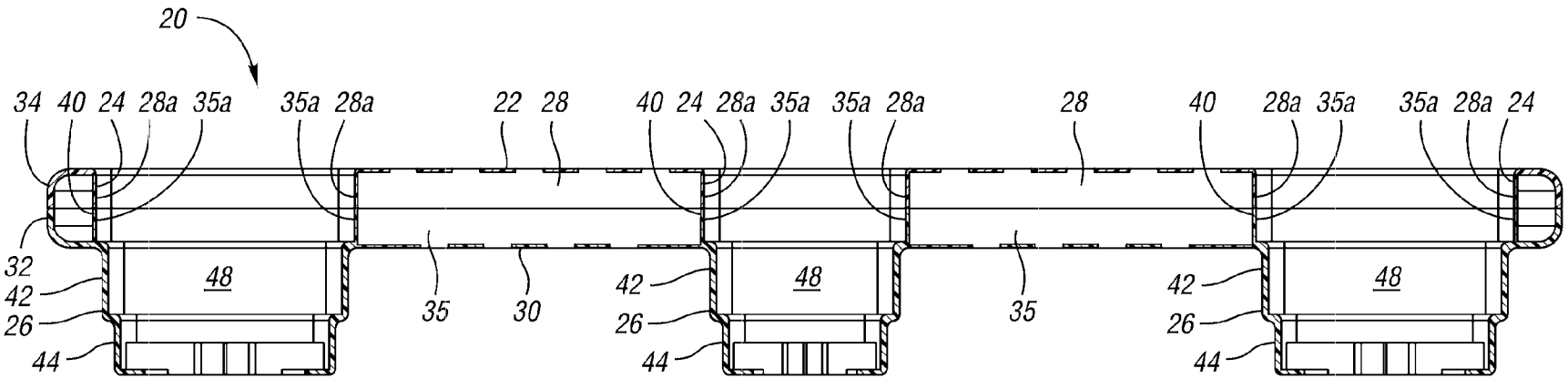
FIG. 3*b* is a sectional view of the pallet of FIG. 1 along line b-b.

FIGS. 3*a* and 3*b* are sectional views through lines a-a and b-b, respectively, of FIG. 1. As can be seen in FIGS. 3*a* and 3*b*, the lower rib sections 35 extend upward, generally perpendicularly to lower panel 30. The lower rib sections 35 are aligned with and mated to the upper ribs sections 28 in upper panel 22. The lower rib sections 35, upper rib sections 28, upper panel 22 and lower panel 29 together form a box beam cross section.

Again referring to FIGS. 3*a* and 3*b*, each of the feet 26 is tapered downwardly. In particular, each of the feet 26 includes an upper section 40, a middle section 42 and a lower section 44. Each of the sections 40, 42, 44 are concentric and decreasing in cross-sectional area with each succeeding downward section. The upper rib sections 28*a* and lower rib sections 35*a* form the upper section 40 of each of the feet 26 between upper panel 22 and lower panel 30. Load on upper panel 22 is thus transferred directly to each upper rib section 28*a*, then to an abutting lower rib section 35*a*, then to a middle section 42 of each foot 26 and then to each lower section 44 of each foot 26, thus increasing the strength of nestable pallet 20. Each opening 24 and foot 26 define a cavity 48 for receiving a corresponding foot 26 from another similar pallet 20.

Figure 4:
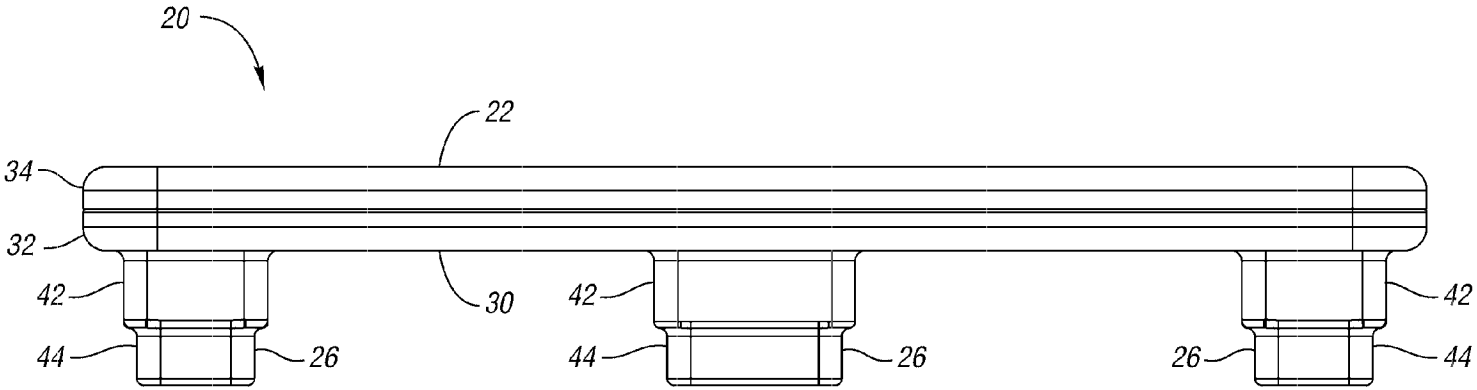
FIG. 4 is an end elevational view of the pallet of FIG. 1.
Figure 5:
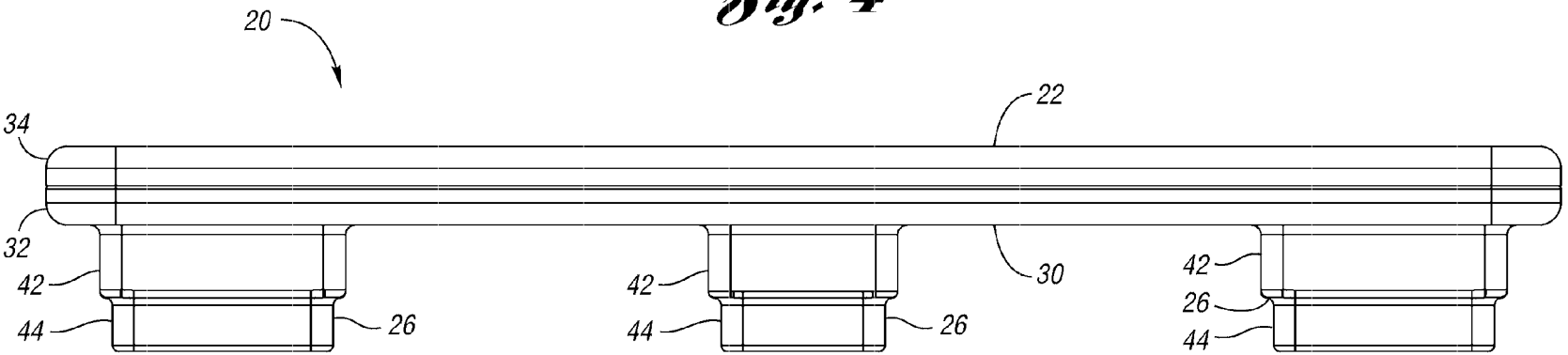
FIG. 5 is a side elevational view of the pallet of FIG. 1.
Figure 6:
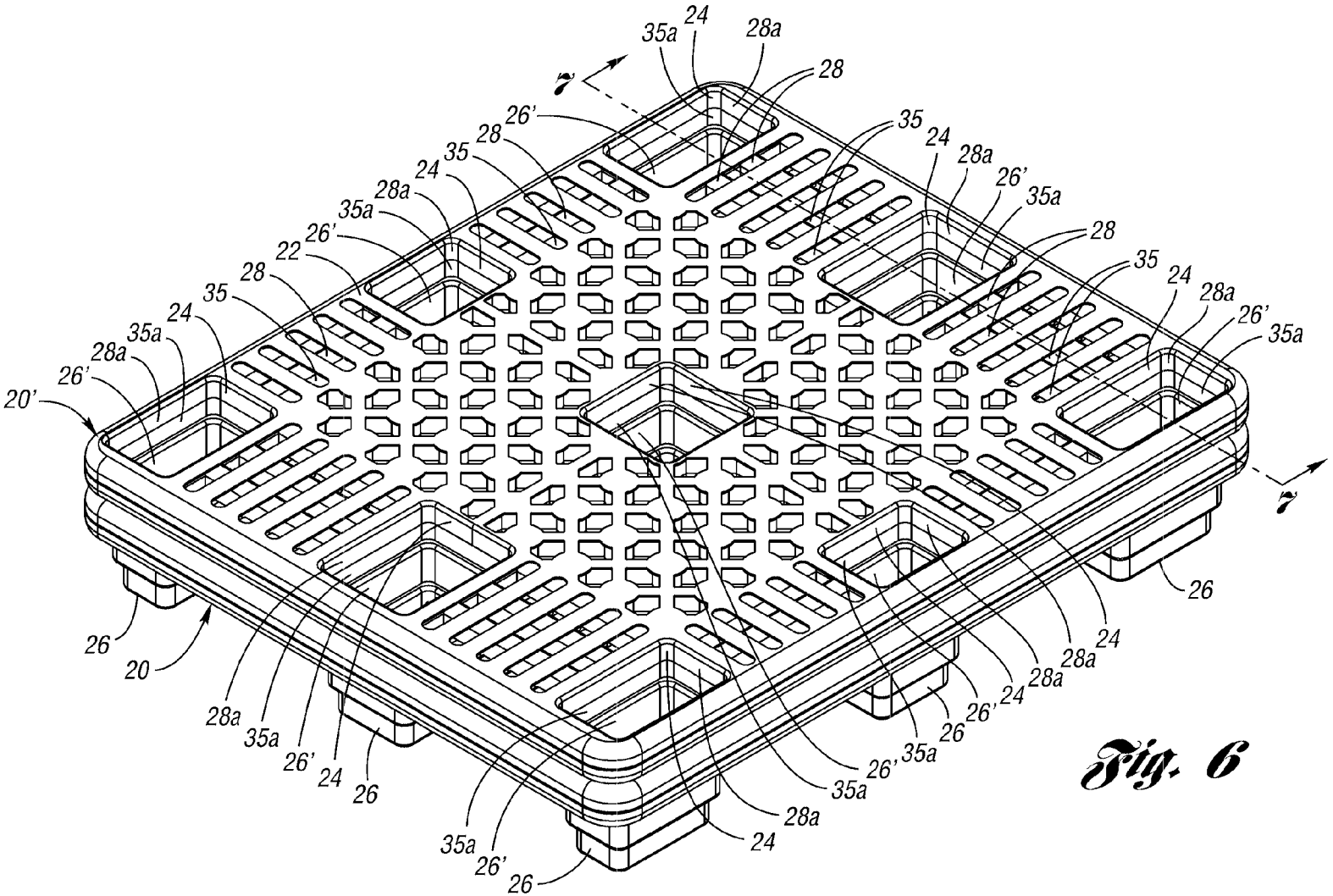
FIG. 6 is a perspective view of the pallet of FIG. 1 nested with a similar pallet.
Figure 7:
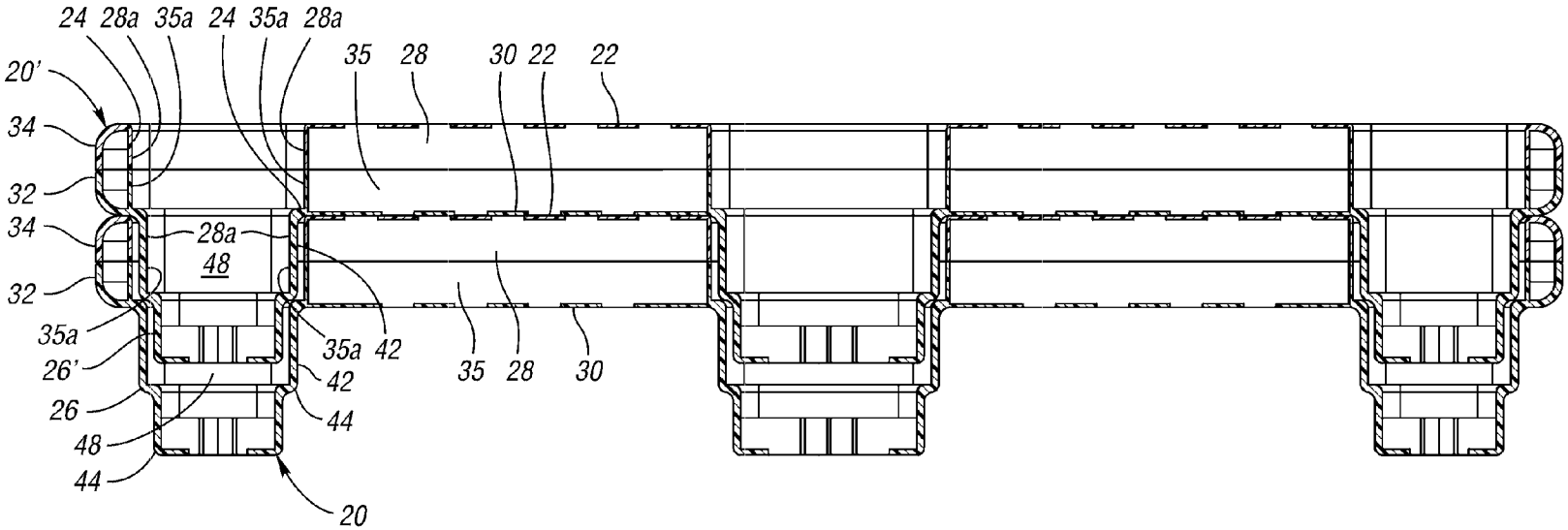
FIG. 7 is a sectional view along the line 7-7 of FIG. 6.

FIGS. 4 and 5 show an end view and a side view of the nestable pallet of FIG. 1. FIG. 6 is a perspective view of the nestable pallet 20 of FIGS. 1-5, with a similar pallet 20' nested therein, while FIG. 7 is a sectional view along lines 7-7 of FIG. 6. Referring to FIGS. 6 and 7, the feet 26' of the pallet 20' nest within the feet 26 of the pallet 20, thus reducing the overall height of the empty pallets 20, 20'.

FIGS. 8-15 show a second embodiment of a nestable pallet 120 of the present invention. The nestable pallet 120 is generally similar to that shown in the previous Figures and will thus be described more briefly. To the extent not described below or shown in the drawings to be otherwise, the nestable pallet 120 has similar structure, features and operation to those described and shown above. Generally, structure in FIGS. 8-15 corresponding to structure in FIGS. 1-7 will be referenced with the same reference numeral with the numeral "1" prepended.

Figure 8:
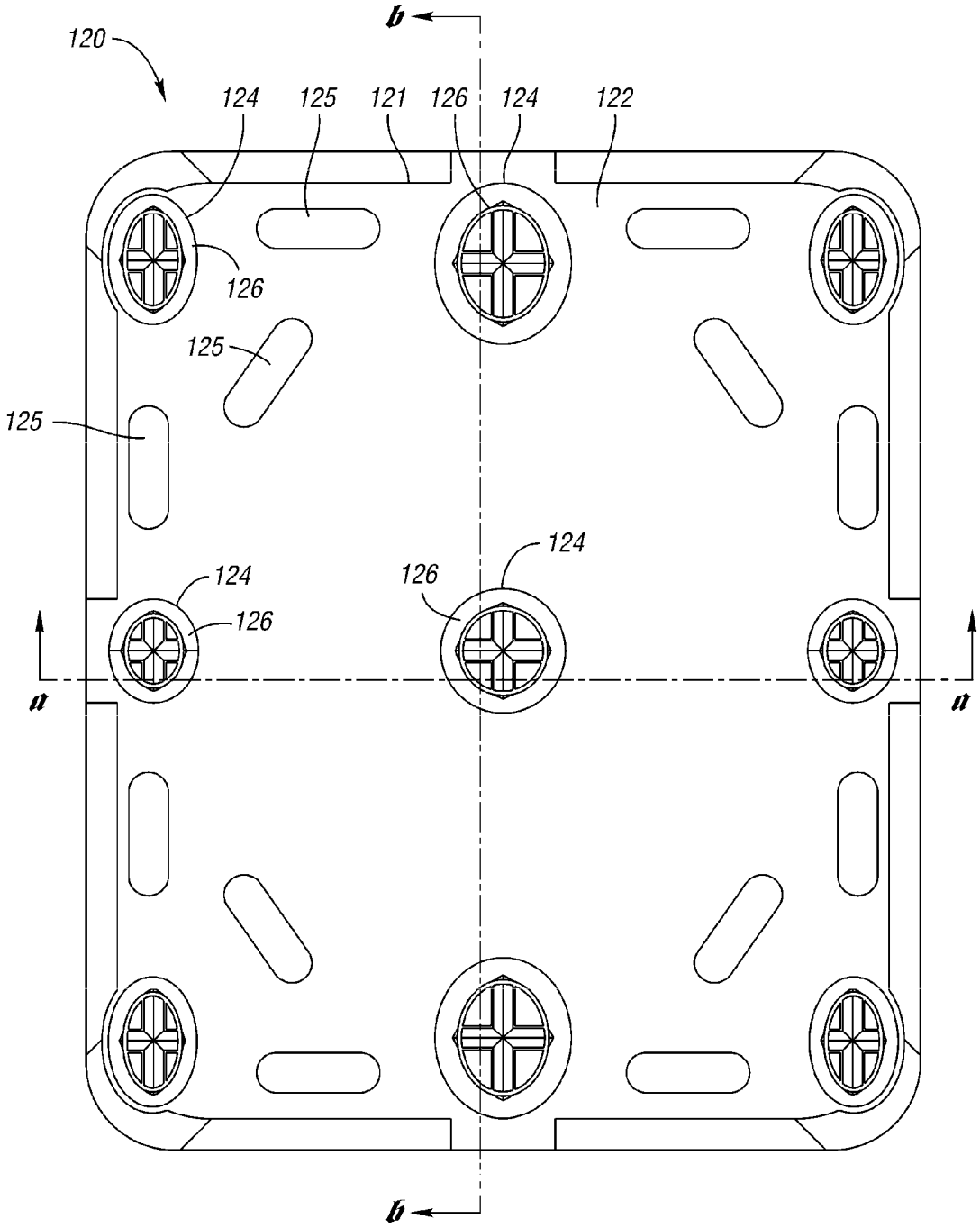
FIG. 8 is a top view of a second embodiment of the nestable pallet of the present invention.

Referring to FIG. 8, the nestable pallet 120 includes an upper deck section 121 comprising an upper panel 122 having a plurality of openings 124 aligned with feet 126 extending downwardly from the pallet 120. In this embodiment, the pallet 120 includes molded handle openings 125 through the deck sections.

Figure 9:
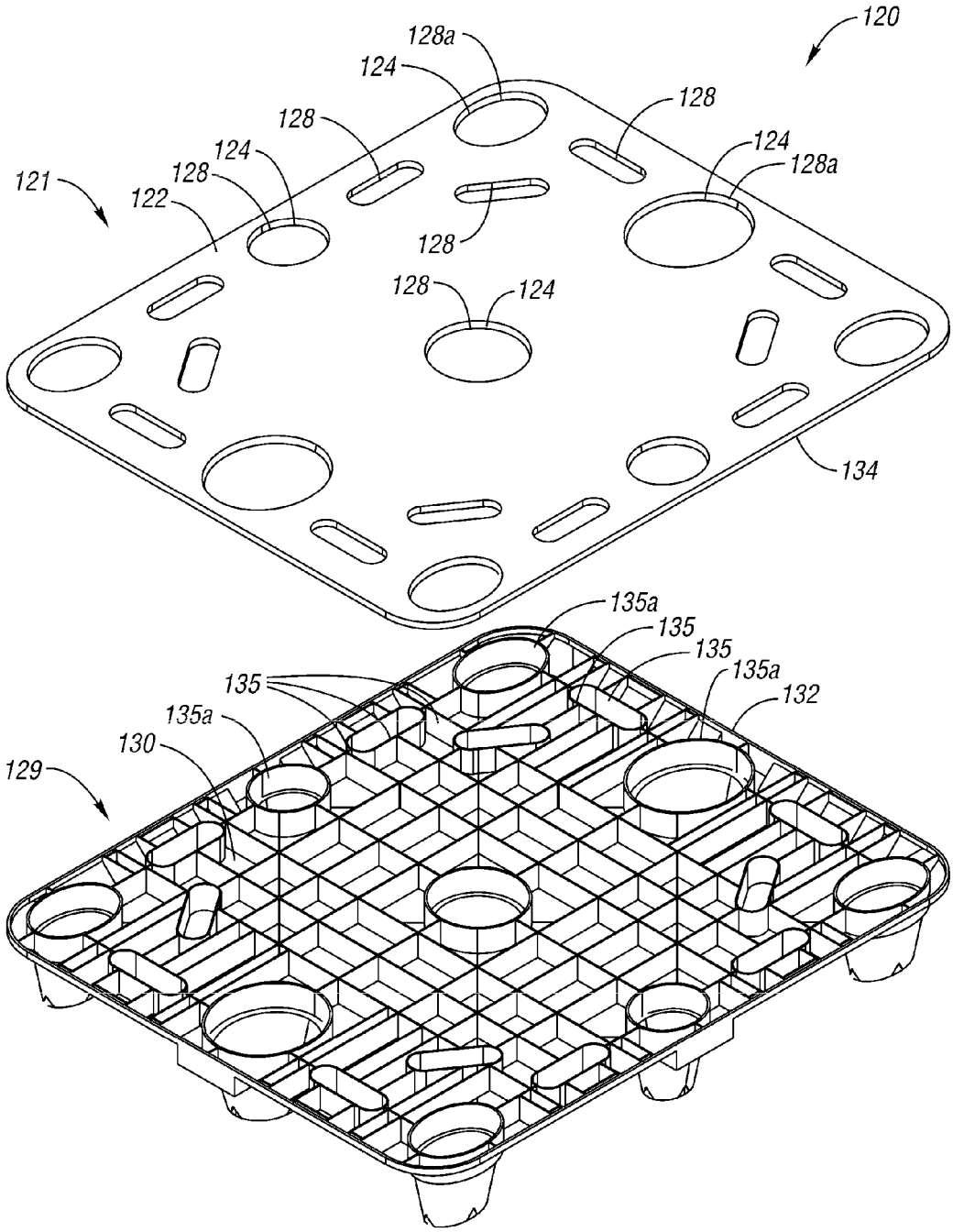
FIG. 9 is an exploded perspective view of a section of the nestable pallet of FIG. 8.

FIG. 9 is an exploded perspective view of the upper deck section 121 and a corresponding lower deck section 129. The lower deck section 129 includes a lower panel 130 having a lip 132 about its periphery for mating with a similar lip 134 of upper panel 122. The upper rib sections 128 extend downward from the upper panel 122. A plurality of lower rib sections 135 extend upward from the lower panel 130 (some between each adjacent pair of feet 26) in general alignment with corresponding upper rib sections 128. Some of the upper and lower rib sections 128*a*, 135*a* are aligned with and disposed about each of the openings 124 in upper panel 122 to form a portion of each of the feet 126.

Figure 10A:
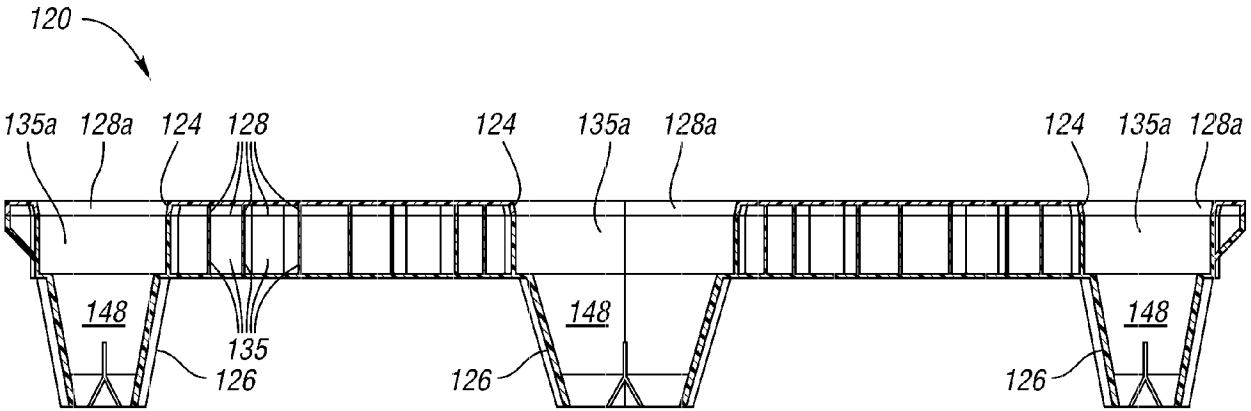
FIG. 10*a* is a sectional view through the nestable pallet of FIG. 8 along line a-a.
Figure 10B:
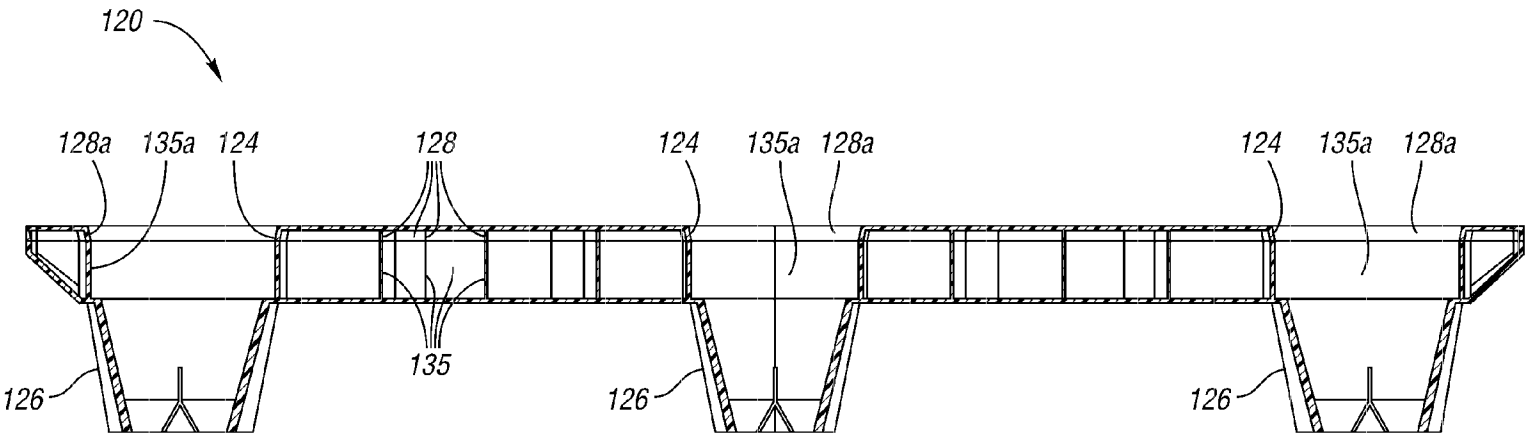
FIG. 10*b* is a sectional view of the pallet of FIG. 8 along line b-b.

FIGS. 10*a* and 10*b* are sectional views through lines a-a and b-b, respectively, of FIG. 9. As can be seen in FIGS. 10*a* and 10*b*, each of the feet 126 is tapered downwardly constantly below the lower rib sections 135*a*. Each opening 124 and foot 126 define a cavity 148 for receiving a corresponding foot 126 from another similar pallet 120.

Figure 11:
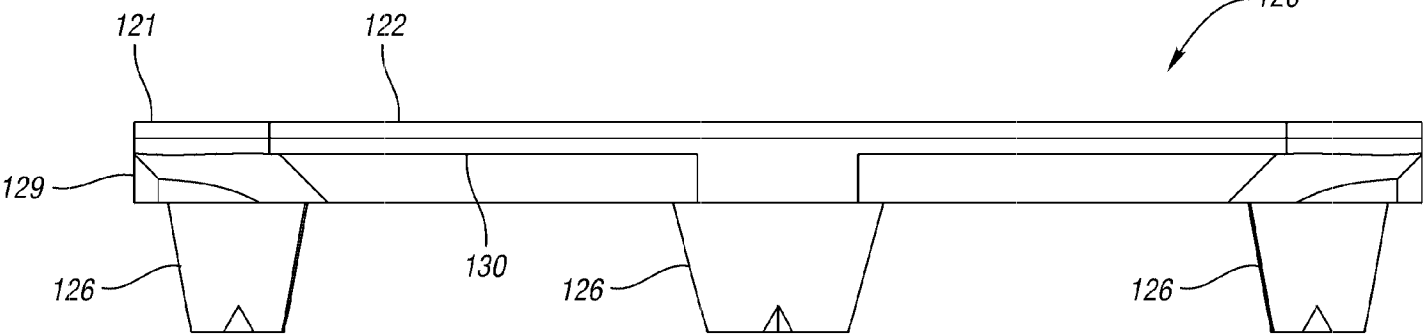
FIG. 11 is an end elevational view of the pallet of FIG. 8.
Figure 12:
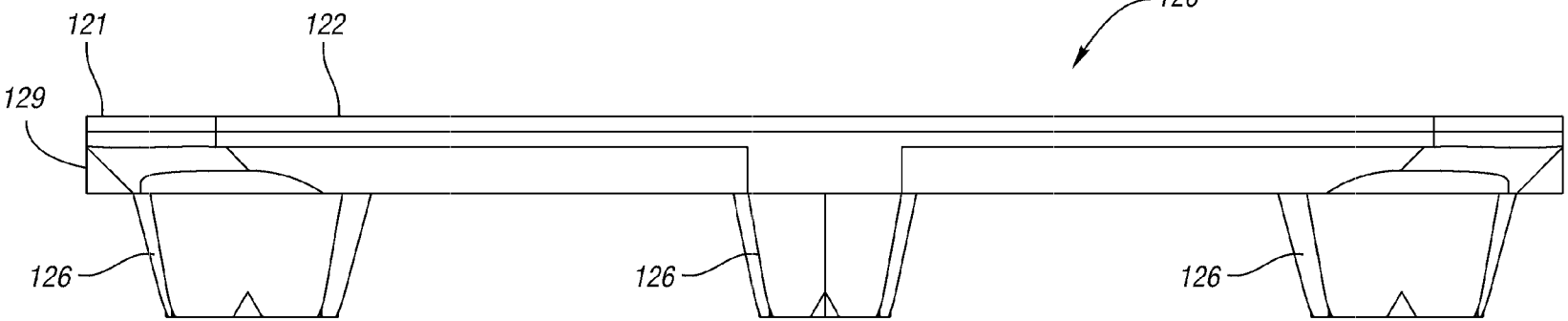
FIG. 12 is a side elevational view of the pallet of FIG. 8.
Figure 13:
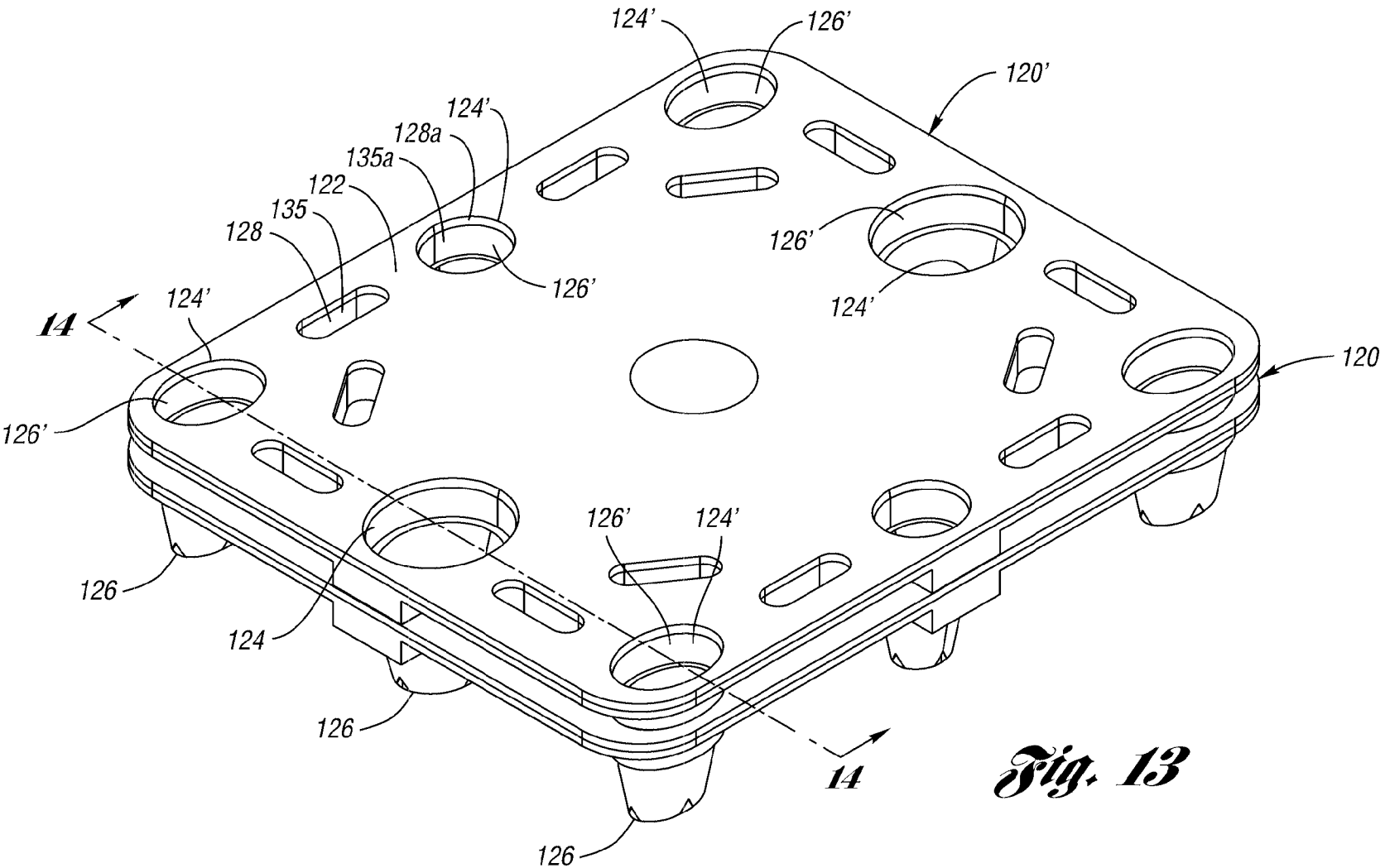
FIG. 13 is a perspective view of the pallet of FIG. 8 nested with a similar pallet.
Figure 14:
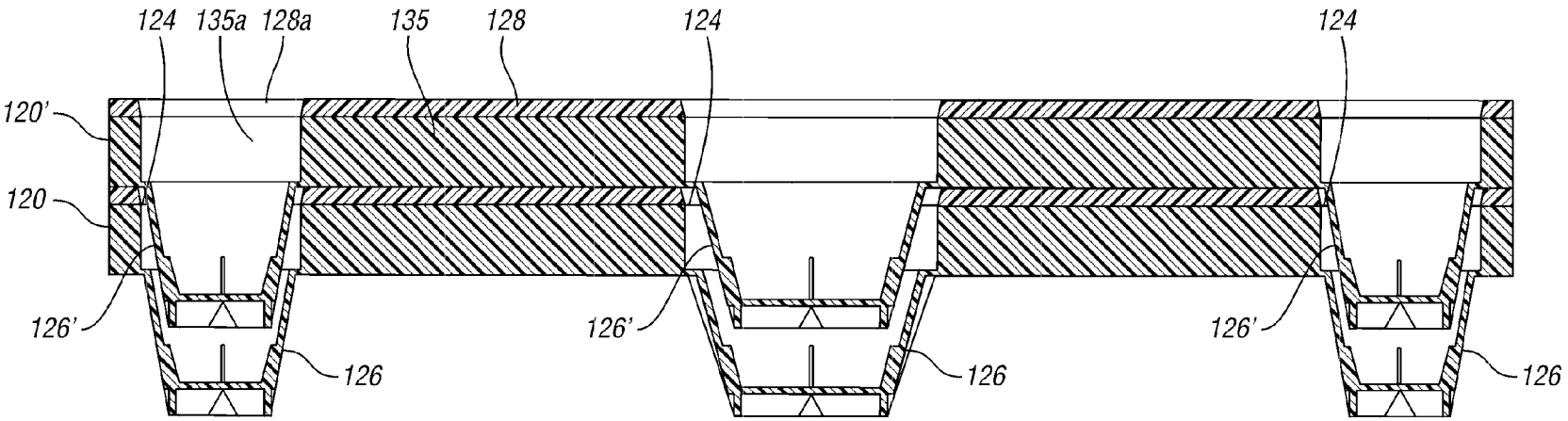
FIG. 14 is a sectional view along the line 14-14 of FIG. 13 of the nested pallets.
Figure 15:
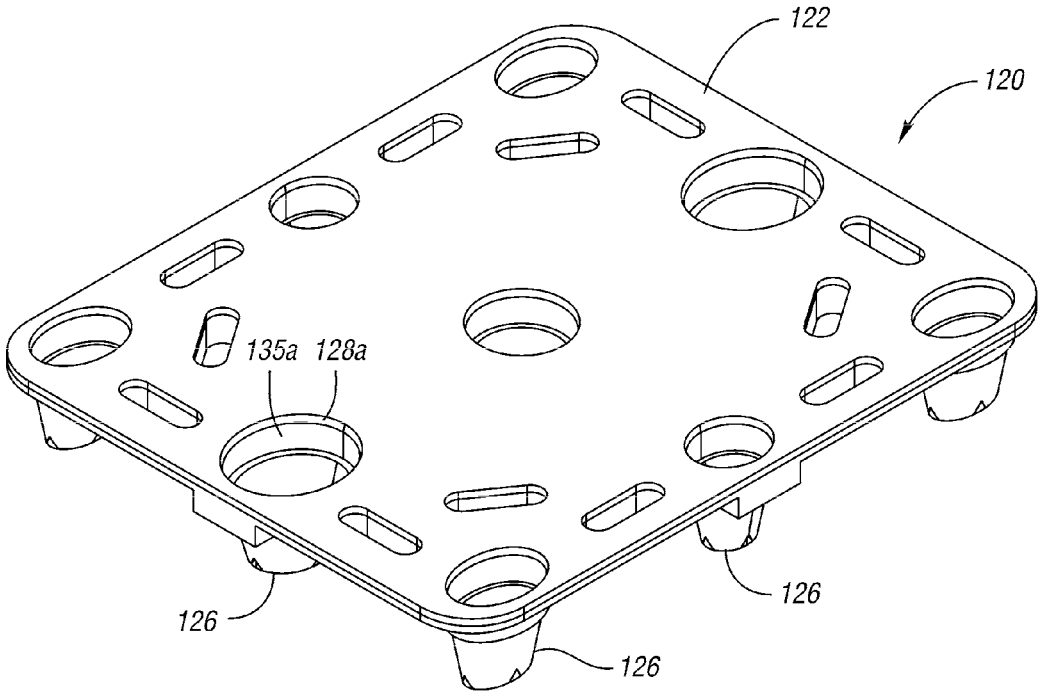
FIG. 15 is a perspective view of the nestable pallet of FIG. 8.

FIGS. 11 and 12 show an end view and a side view of the nestable pallet of FIG. 8. FIG. 13 is a perspective view of the nestable pallet 120 of FIGS. 1-5, with a similar pallet 120' nested therein, while FIG. 14 is a sectional view along lines 14-14 of FIG. 13. Referring to FIGS. 13 and 14, the feet 126' of the pallet 120' nest within the feet 126 of the pallet 120, thus reducing the overall height of the empty pallets 120, 120'.

Figure 16:
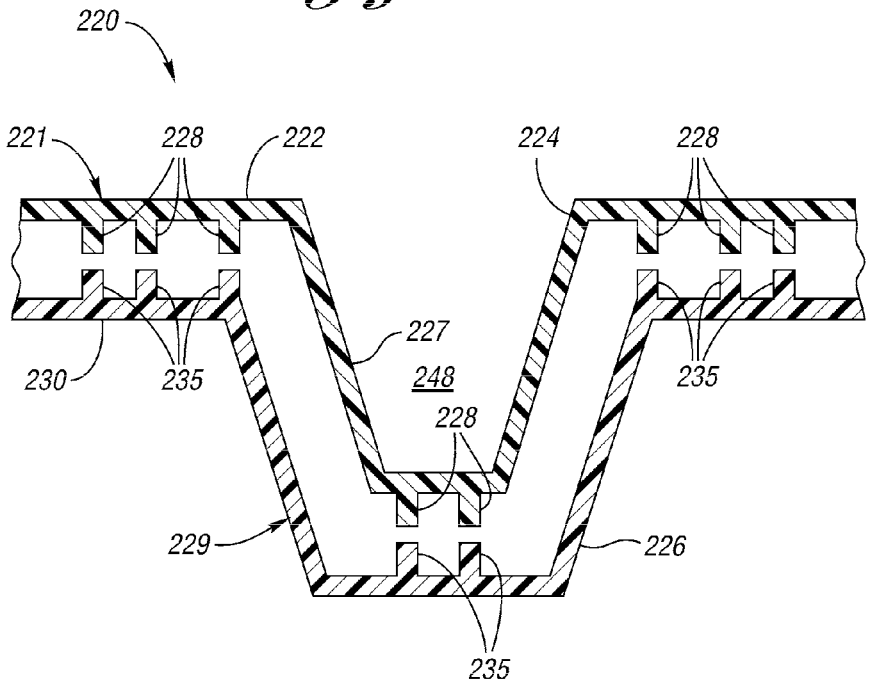
FIG. 16 is an exploded sectional view through a portion of a third embodiment of the nestable pallet of the present invention.

FIG. 16 is an exploded sectional view showing an alternate foot 226 in a third embodiment nestable pallet 220 of the present invention. In this pallet 220, the upper deck section 221 includes a downwardly projecting foot 227 extending from the upper panel 222 and aligned with the foot 226 of the lower deck section 229. The foot 227 of the upper deck section 221 includes upper rib sections 228 aligned with and mateable with lower rib sections extending upward from the foot 226 of the lower deck section 221.

The nestable pallets 20, 120, 220 of the present invention provide the increased strength and durability of the box beam section in a nestable pallet 20, 120, 220. Thus, the inventive pallet 20, 120, 220 has increased strength and durability in use and is also convenient to store and transport when empty.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. There are many different configurations for plastic pallets and many variations in design, many of which would benefit from the present invention. For example, the upper and lower deck sections 21, 29, 121, 129 are preferably formed of polypropylene via an injection molding process, but of course can be formed of any type of plastic applicable for the desired use. The number and arrangement of openings 24, 125, 224 and feet 26, 126, 226, 227 may vary according to the size of the pallet 20, 120, 220 and the intended application for the pallet 20, 120, 220.

What is claimed is:

1. A nestable pallet comprising:

a lower panel having a peripheral lip, the peripheral lip generally extending along an outer edge of the pallet in a first direction;

first and second feet disposed near the outer edge, and wherein the first and second feet are tapered downwardly from the lower panel;

a first plurality of lower ribs extending upward from the lower panel, wherein the first plurality of lower ribs extend from the first foot to the second foot in a second direction generally parallel to the first direction;

a second plurality of lower ribs extending upward from the lower panel, wherein the second plurality of lower ribs are positioned further from the outer edge than the first plurality of lower ribs, wherein the second plurality of lower ribs include a plurality of cylindrical ribs and a plurality of connecting ribs between the cylindrical ribs, wherein the connecting ribs extend in directions that are non-parallel with the first and second directions, and wherein each of the connecting ribs extends from an outer diameter of one of the cylindrical ribs to an outer diameter of another one of the cylindrical ribs, wherein the cylindrical ribs each have the same diameter; and an upper panel including openings aligned with the first and second feet, wherein the openings and the first and second feet define cavities configured to receive feet from a similar pallet.

2. The nestable pallet of claim 1, wherein the lower panel partially defines a lower deck section of the pallet, and wherein the upper panel partially defines an upper section of the pallet.

3. The nestable pallet of claim 1, wherein the first plurality of lower ribs are non-cylindrical.

4. The nestable pallet of claim 1, wherein the first and second plurality of lower ribs extend perpendicularly upward from the lower panel.

5. The nestable pallet of claim 4, wherein the first plurality of lower ribs includes at least two spaced apart ribs.

6. The nestable pallet of claim 5, wherein the first plurality of lower ribs includes four spaced apart ribs.

7. The nestable pallet of claim 1, wherein the peripheral lip defines the outermost edge of the lower panel.

8. The nestable pallet of claim 7 wherein the peripheral lip extends around the entire pallet.

9. The nestable pallet of claim 1 further including a central foot that is positioned further from the outer edge than the first and second feet.

10. The nestable pallet of claim 1, wherein the first and second feet each include an upper section and a lower section having a diameter less than the upper section, and wherein each upper section is at least partially defined by a respective section of lower ribs extending upward from the lower panel.

11. The nestable pallet of claim 10, wherein the upper section is at least partially defined by a respective section of upper ribs extending downward from the upper panel.

12. The nestable pallet of claim 10, wherein the lower section is connected to the upper section by way of a middle section, the middle section having a diameter less than the upper section, the lower section having a diameter less than the middle section.

13. The nestable pallet of claim 1, wherein the first plurality of lower ribs contacts each of the first and second feet.

14. The nestable pallet of claim 1, wherein one of the plurality of connecting ribs extends from an innermost rib of the first plurality of lower ribs.

15. The nestable pallet of claim 1, wherein the upper panel includes a peripheral lip mating with the peripheral lip of the lower panel.

16. The nestable pallet of claim 15, wherein the upper panel includes a first plurality of upper ribs extending down from the upper panel, the plurality of first upper ribs aligning with respective ones of the first plurality of lower ribs.

17. A nestable pallet comprising:

a lower panel having a peripheral lip, the peripheral lip generally extending along an outer edge of the pallet in a first direction;

first and second feet disposed near the outer edge, and wherein the first and second feet are tapered downwardly from the lower panel;

a first plurality of lower ribs extending upward from the lower panel, wherein the first plurality of lower ribs extend from the first foot to the second foot in a second direction generally parallel to the first direction;

a second plurality of lower ribs extending upward from the lower panel, wherein the second plurality of lower ribs are positioned further from the outer edge than the first plurality of lower ribs, wherein the second plurality of lower ribs include a plurality of cylindrical ribs and a plurality of connecting ribs between the cylindrical ribs, wherein the connecting ribs extend in directions that are non-parallel with the first and second directions, and wherein each of the connecting ribs extends from an outer face of one of the cylindrical ribs to an outer face of another one of the cylindrical ribs without extending inside either of the cylindrical ribs; and an upper panel including openings aligned with the first and second feet, wherein the openings and the first and second feet define cavities configured to receive feet from a similar pallet.

18. The pallet of claim 17, wherein the outer faces of the cylindrical ribs face one another.

19. The pallet of claim 18, wherein the inside of a cylindrical rib is located inward of the outer face of the cylindrical rib.

20. A nestable pallet comprising:

a lower panel having a peripheral lip, the peripheral lip generally extending along an outer edge of the pallet in a first direction;

first and second feet disposed near the outer edge, and wherein the first and second feet are tapered downwardly from the lower panel;

a first plurality of lower ribs extending upward from the lower panel, wherein the first plurality of lower ribs extend from the first foot to the second foot in a second direction generally parallel to the first direction;

a second plurality of lower ribs extending upward from the lower panel, wherein the second plurality of lower ribs are positioned further from the outer edge than the first plurality of lower ribs, wherein the second plurality of lower ribs include a plurality of cylindrical ribs and a plurality of connecting ribs between the cylindrical ribs, wherein the connecting ribs extend in directions that are non-parallel with the first and second directions, wherein each of the connecting ribs extends from an outer face of one of the cylindrical ribs to an outer face of another one of the cylindrical ribs, and wherein the cylindrical ribs are centered around different axes; and an upper panel including openings aligned with the first and second feet, wherein the openings and the first and second feet define cavities configured to receive feet from a similar pallet.

* * * * *